US006852041B1

(12) United States Patent
Huang

(10) Patent No.: US 6,852,041 B1
(45) Date of Patent: Feb. 8, 2005

(54) GOLF CLUB HEAD AND MANUFACTURING METHOD THEREFOR

(75) Inventor: Chun-Yung Huang, Kaohsiung Hsien (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 8 days.

(21) Appl. No.: 10/624,526

(22) Filed: Jul. 23, 2003

(51) Int. Cl.[7] ..... A63B 53/04
(52) U.S. Cl. ..... 473/342; 473/350; 29/458
(58) Field of Search ..... 473/342, 350; 29/458, 509, 513

(56) References Cited

U.S. PATENT DOCUMENTS 5,816,936 A * 10/1998 Aizawa et al. ..... 473/342
5,871,408 A * 2/1999 Chen ..... 473/409
5,945,157 A * 8/1999 Lee et al. ..... 427/198
5,967,903 A * 10/1999 Cheng ..... 473/342
6,623,376 B2 * 9/2003 Poynor ..... 473/342
2002/0025861 A1 * 2/2002 Ezawa ..... 473/342
2004/0099356 A1 * 5/2004 Wu ..... 148/671

* cited by examiner

*Primary Examiner*—Stephen Blau
(74) *Attorney, Agent, or Firm*—Birch, Stewart, Kolasch & Birch, LLP

(57) ABSTRACT

A golf club head includes a golf club head body and a striking plate. The golf club head body has a recession in a side thereof. The striking plate is embedded in the recession of the golf club head body. The striking plate includes a front face acting as a striking face and a rear face that is a highly polished surface. A reinforcing metal layer is formed on the highly polished surface of the striking plate and has a hardness higher than 1000 HV for protecting the highly polished surface.

12 Claims, 7 Drawing Sheets

GOLF CLUB HEAD AND MANUFACTURING METHOD THEREFOR

BACKGROUND OF THE INVENTION

1. Field of the Invention

The present invention relates to a golf club head and a method for manufacturing the golf club head.

2. Description of Related Art

Conventionally, a striking plate of a golf club head is made by means of forging, pressing, or mechanical processing a metal alloy material to form a predetermined shape. The striking plate has a front face (i.e., the striking face) and a rear face. The front face of the striking plate is polished and processed to form plural grooves for increasing the friction, accuracy, and distance of striking. The rear face of the striking plate is preferably processed by electrolytic polishing, chemical polishing, or vibrational grinding/polishing to provide a highly polished surface or regular patterns. The highly polished surface has a surface roughness below 6.3 $\mu$m such that the rear face of the striking plate is capable of uniformly absorbing and dispersing the striking stress, avoiding generation of cracks in the rear face of the striking plate. After formation of a highly polished surface on the rear face of the striking plate, the striking plate can be mounted to a golf club head body through appropriate assembling procedures to form a golf club head.

Although it is possible to form a highly polished surface on the rear face of the club head of a wooden club or iron club to improve the fatigue strength of the striking plate and to prolong the life of the striking plate, formation of the highly polished surface on the rear face of the striking plate must be completed before mounting the striking plate to the club head body. The highly polished surface may be impacted and thus scraped or damaged by the required devices and machines during the welding and mounting procedures as well as other processing and transport procedures. Damage to the highly polished surface largely and adversely affects its completeness, reducing the fatigue strength of the striking plate and adversely affecting the appearance of the product.

OBJECTS OF THE INVENTION

An object of the present invention is to provide a golf club head, wherein a reinforcing metal layer having a hardness of 1000–4000 HV is formed by physical vapor deposition or plating on a highly polished surface of a rear face of the striking plate. The striking plate has improved abrasion-resistance to protect the highly polished surface during the assembling procedure. Further, the fatigue strength and the coefficient of restitution of the striking plate are improved, increasing the ratio of qualified products to disqualified products. The color of the reinforcing metal layer may be varied by means of changing the material for the reinforcing metal layer to thereby provide an aesthetically pleasing appearance of the rear face of the striking plate.

Another object of the present invention is to provide a method for manufacturing a golf club head having a reinforcing metal layer formed on the rear face of the striking plate thereof.

SUMMARY OF THE INVENTION

To achieve the aforementioned objects, the present invention provides a golf club head including a golf club head body and a striking plate. The golf club head body has a recession in a side thereof. The striking plate is embedded in the recession of the golf club head body. The striking plate includes a front face acting as a striking face and a rear face that is a highly polished surface. A reinforcing metal layer is formed on the highly polished surface of the striking plate and has a hardness higher than 1000 HV for protecting the highly polished surface.

A method for manufacturing a golf club head in accordance with the present invention comprises forming a highly polished surface on a rear face of a striking plate; forming a reinforcing metal layer on the highly polished surface of the striking plate; inserting the striking plate into a golf club head body having a recession and a welding flange; deforming the welding flange of the golf club head body along an outer periphery of the striking plate; welding the welding flange to fuse the golf club head body and the striking plate along a boundary between the golf club head body and the striking plate; and finishing the welded portion of the golf club head and the striking plate.

Other objects, advantages and novel features of this invention will become more apparent from the following detailed description when taken in conjunction with the accompanying drawings.

DETAILED DESCRIPTION OF THE PREFERRED EMBODIMENT

A preferred embodiment of the present invention is now to be described hereinafter in detail.

Figure 1:
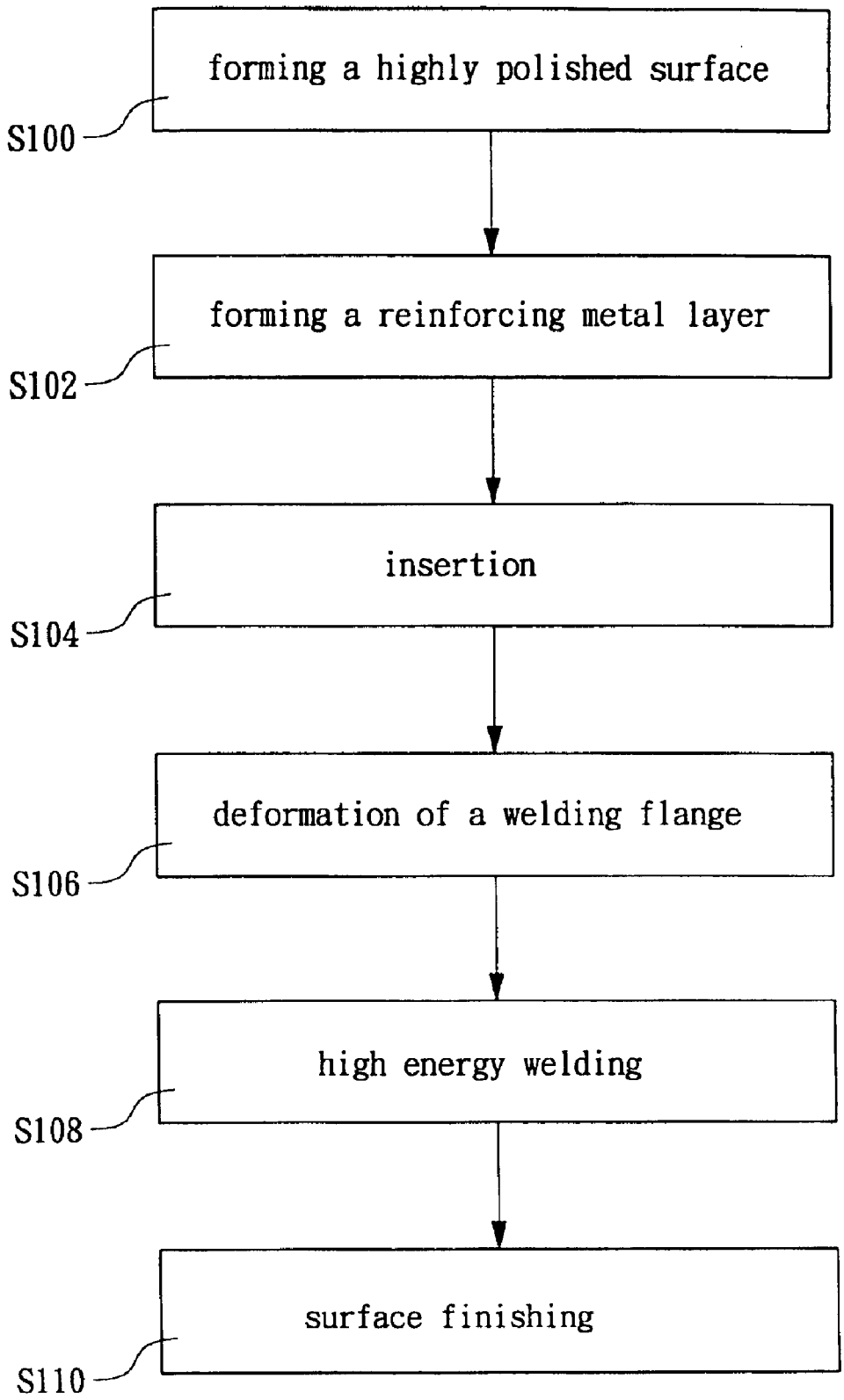
FIG. 1 is a flowchart illustrating a method for manufacturing a golf club head in accordance with the pre sent invention.
Figure 2:
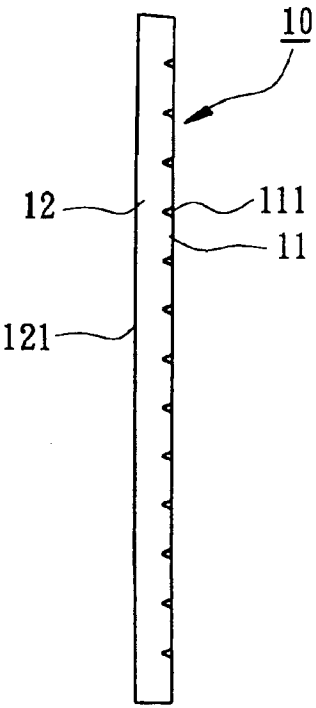
FIG. 2 is a sectional view of a striking plate before formation of a reinforcing metal layer on the rear face of the striking plate.

FIG. 1 is a flowchart illustrating a method for manufacturing a golf club head in accordance with the present invention. FIG. 2 is a sectional view of a striking plate before formation of a reinforcing metal layer on the rear face 12 of the striking plate. Referring to FIGS. 1 and 2, a method for manufacturing a golf club head in accordance with the present invention comprises forming a highly polished surface 121 on a rear face of a striking plate 10 (step S100). The striking plate 10 is made of a material with a higher coefficient of restitution (COR), such as special steel (such as carbon steel of 4130), stainless steel (such as stainless steel of SUS174, 350, 455), or titanic alloy (such as an alloy of 6Al-4VTi). The material is forged, pressed, or mechanically processed to form a striking plate. The striking plate 10 can be used with a golf club head of a wooden club or iron club.

Figure 5:
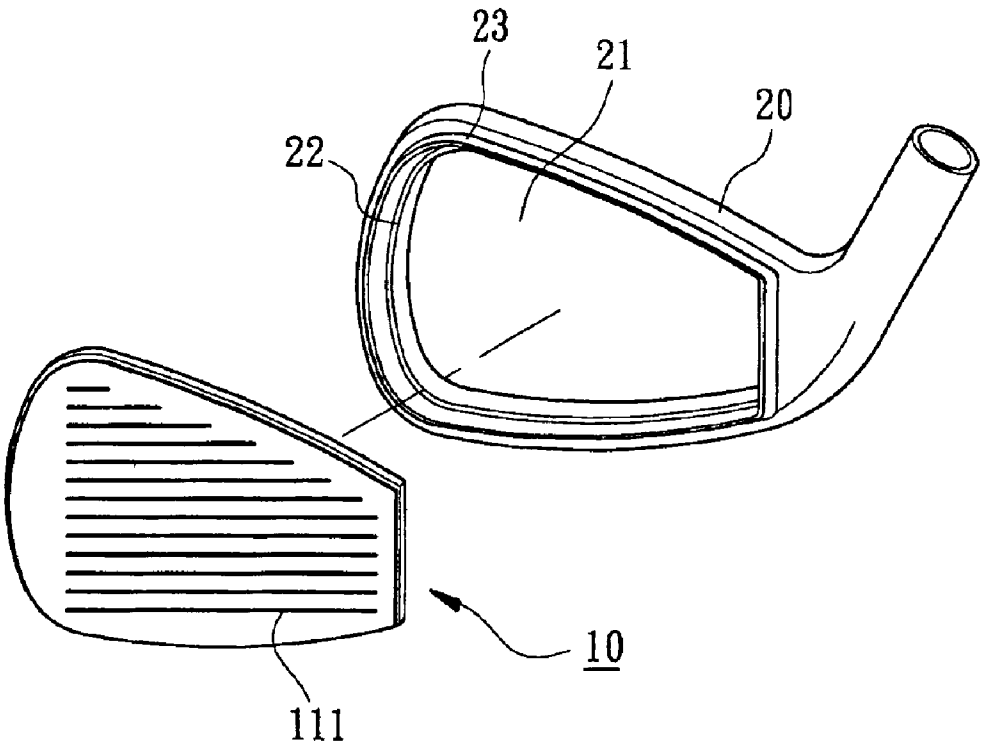
FIG. 5 is an exploded perspective view of a striking plate and a golf club head body in accordance with the present invention.

The striking plate 10 generally includes a front face 11 and a rear face 12. The front face 11 forms a striking face for striking a golf ball. Further, plural grooves 111 (FIG. 5) may be formed in the front face 11 for increasing the friction, accuracy, and distance of striking of the striking plate 10. The rear face 12 of the striking plate 10 is processed by electrolytic polishing, chemical polishing, or vibrational grinding polishing to provide a highly polished surface with a surface roughness below 6.3 μm (preferably below 3.5 μm), thereby increasing the fatigue strength and the COR of the striking plate 10.

The next step of the method for manufacturing a golf club head includes forming a reinforcing metal layer 13 on the highly polished surface 121 of the striking plate 10 (step S102). In particular, a reinforcing metal layer 13 is form ed on the highly polished surface 121 of the striking plate 10 by physical vapor deposition (PVD) or plating. The physical vapor deposition includes evaporation and sputtering.

Figure 3:
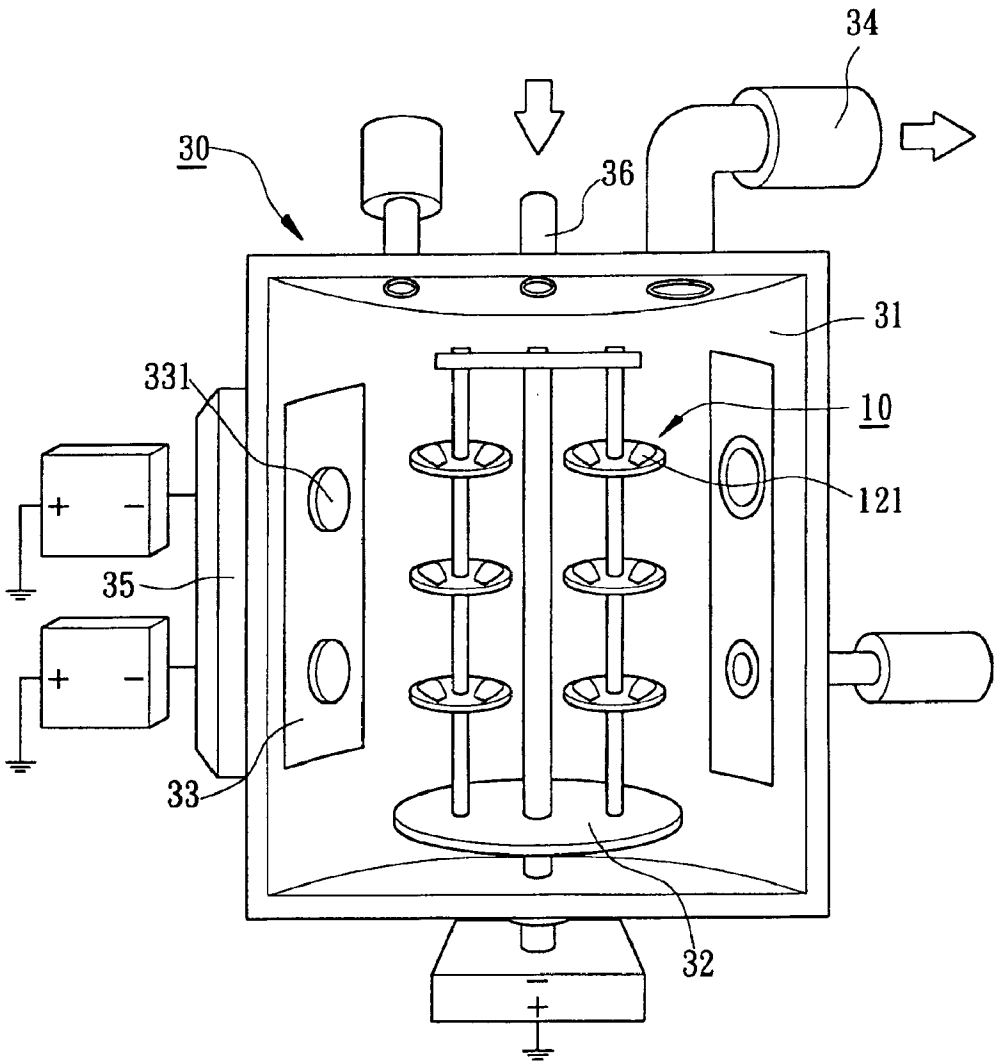
FIG. 3 is a schematic view of an apparatus for proceeding with physical vapor deposition for forming a reinforcing metal layer on a rear face of the striking plate.
Figure 4:
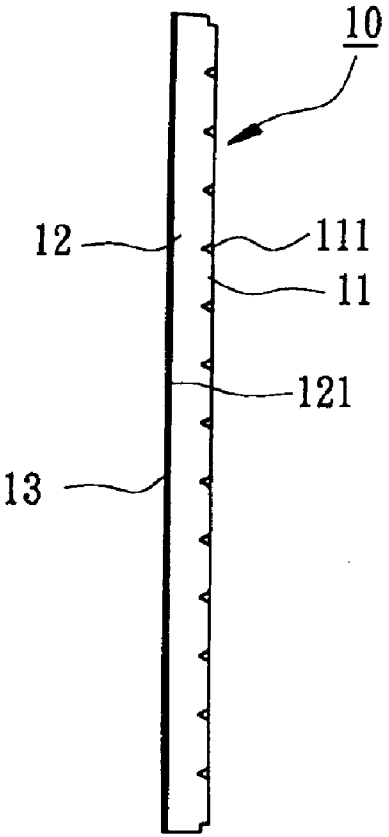
FIG. 4 is a sectional view of the striking plate after formation of the reinforcing metal layer on the rear face of the striking plate.
Figure 6:
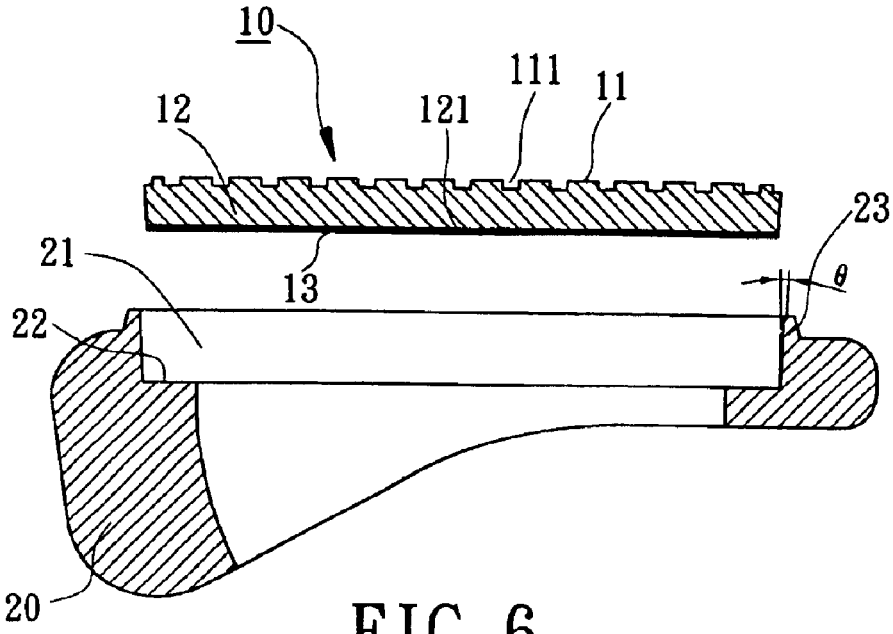
FIG. 6 is an exploded sectional view of the striking plate and the golf club head body in FIG. 5.
Figure 7:
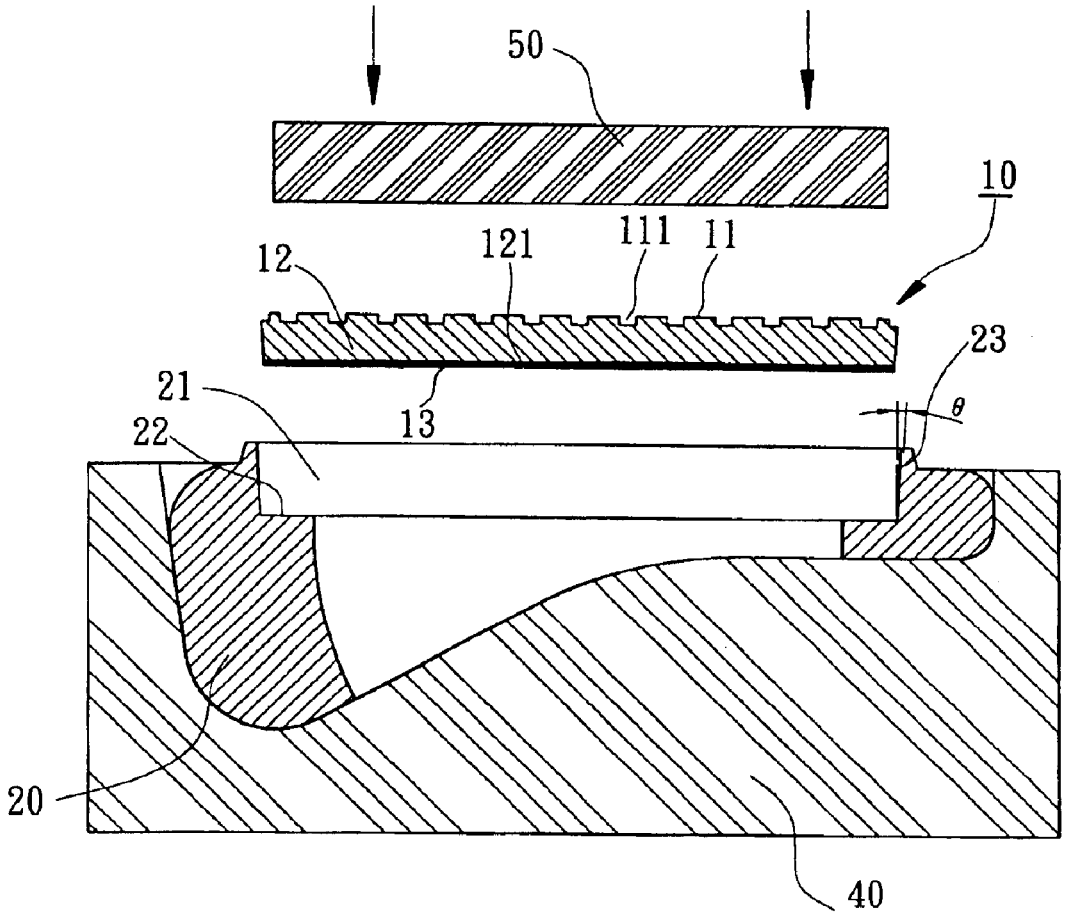
FIG. 7 is an exploded sectional view illustrating insertion of the striking plate into a recession of the golf club head body.

FIG. 3 is a schematic view of an apparatus for proceeding with physical vapor deposition for forming a reinforcing metal layer on a rear face of the striking plate. FIG. 4 is a sectional view of the striking plate after formation of the reinforcing metal layer on the rear face of the striking plate. The reinforcing metal layer 13 can be formed on the highly polished surface 121 of the rear face 12 of the striking plate 10 by an ion evaporation apparatus (FIG. 3) that may create a magnetic field and provide a shield.

As illustrated in FIG. 3, the ion evaporation apparatus 30 includes an evaporation chamber 31, a carrier disc 32, an evaporation source 33, a vacuum pump 34, a heating coil 35, and a filling hole 36. The surface of the striking plate 10 is cleaned and dried. Then, the striking plate 10 is placed into the evaporation chamber 31 and positioned on the carrier disc 32, with the rear face 12 of the striking plate 10 facing upward. Next, at least one evaporation material 331 is fixed on the evaporation source 33. The evaporation material 331 is a metal material having a hardness of 1000–4000, particularly selected from a group consisting of titanium (Ti), zirconium (Zr), hafnium (Hf), chromium (Cr), and combinations thereof (see Table 1).

Next, the evaporation chamber 31 is sealed and then vacuumed by the vacuum pump 34, and the temperature in the evaporation chamber 31 is raised by the heating coil 35. A reactive gas (such as nitrogen, ammonia, acetylene, ethylene, or a combination thereof) selected according to the need of product is filled into the evaporation chamber 31 via the filling hole 16. Then, the evaporation chamber 31 is connected to a positive pole, the evaporation material 331 is connected to a negative pole, and direct current is applied to proceed with evaporation procedure. Arc discharge occurs between the positive pole and the negative pole during the evaporation procedure, causing continuous evaporation and ionization of a portion of small particles of the evaporation material 331. The ionized particles of the evaporation material 331 react with the reactive gas and then move toward the highly polished surface 121 of the striking plate 10 under the action of negative bias voltage. Thus, a reinforcing metal layer 13 (FIG. 4) can be formed on the highly polished surface 121 of the striking plate 10 according to need. The reinforcing metal layer 13 may have a thickness of 1–20 μm. The reinforcing metal layer 13 is preferably a nitride or carbonic nitride of the evaporation material 331, such as TiN, ZrN, HfN, $TiC_xN_{1-x}$, $ZrC_xN_{1-x}$, $Ti_xZr_{1-x}N$, or CrCN.

TABLE 1

| composition of reinforcing metal layer | hardness value (HV) | color |
|---|---|---|
| TiN | 2400 | golden yellow |
| ZrN | 3200 | golden green |
| HfN | 2750 | between yellow and green |
| $TiC_xN_{1-x}$(x = 0.05–50) | 2450–2900 | between reddish and brown |
| $ZrC_xN_{1-x}$(x = 0.05–20) | 3250–3450 | golden |
| $ZrC_xN_{1-x}$(x > 0.9) | 3300–3600 | silver |
| $Ti_xAl_{1-x}N$(x = 0.1–70) | 2400–2900 | golden, between brown and black |
| $Ti_xZr_{1-x}N$(x = 20–80) | 2400–3250 | Golden |
| CrCN | 1500–2000 | silver |

In a case that high strength material (such as chromium) is used, the material can be directly plated on the highly polished surface 121 of the striking plate 20 to form a reinforcing metal layer 13.

Since the nitride or carbonic nitride of metal formed by the physical vapor deposition includes various colors, the reinforcing metal layer 13 covering the rear face 12 of the striking plate 10 provides an aesthetically pleasing colorful appearance and thus increases the value of the golf club.

Further, the thickness of the reinforcing metal layer 13 can be selected according to need. For example, the thickness of the reinforcing metal layer 13 is preferably 1–20 μm if the reinforcing metal layer 13 is provided for improving the abrasion-resistance of the highly polished surface 121 of the striking plate 10.

Referring to FIGS. 1, 5, 6, and 7, the next step of the method for manufacturing a golf club head in accordance with the present invention is inserting the striking plate 10 into a golf club head body 20 (step S104). The golf club head body 20 includes a recession 21, a stepped portion 22, and a welding flange 23. The stepped portion 22 is formed along an inner periphery of the recession 21, and the welding flange 23 is provided along an outer periphery of the recession 21. Further, the inner periphery of the recession 21 is inclined outward by an angle θ (smaller than 5) from a bottom portion thereof toward a top portion thereof. Further, an outer periphery of the striking plate 10 is inclined outward by the angle θ from a bottom portion thereof toward a top portion thereof.

A smaller pressing member 50 is used to press the striking plate 10 to thereby insert the striking plate 10 into the recession 21 of the golf club head body 20. It is noted that the striking plate 10 has been processed at the front face 11 and the rear face 12 (including the highly polished surface 121 and the reinforcing metal layer 13) thereof before inserting the striking plate 10 into the recession 21 of the golf club head 20. Thus, the reinforcing metal layer 13 on the rear face 12 of the striking plate 10 may effectively protect the highly polished surface 121 during the assembling procedure.

The welding flange 23 is preferably integrally formed on the outer periphery of the recession 21. Preferably, welding flange 23 has an outer periphery that inclines inward to form an inclined face (not labeled). Thus, when the welding flange 23 is pressed, the metal material of the welding flange 23 is apt to deform toward an inner side thereof, forming a thin sheet of metal that covers a boundary between the golf club head body 20 and the striking plate 10.

Referring to FIGS. 1, 8, 9, and 10, the next step of the method for manufacturing a golf club head in accordance with the present invention is deforming the welding flange 23 of the golf club head body 20 along the outer periphery of the striking plate 10 by means of using the first pressing member 51 and a second pressing member 52 to press the welding flange 23 (step S106).

Figure 8:
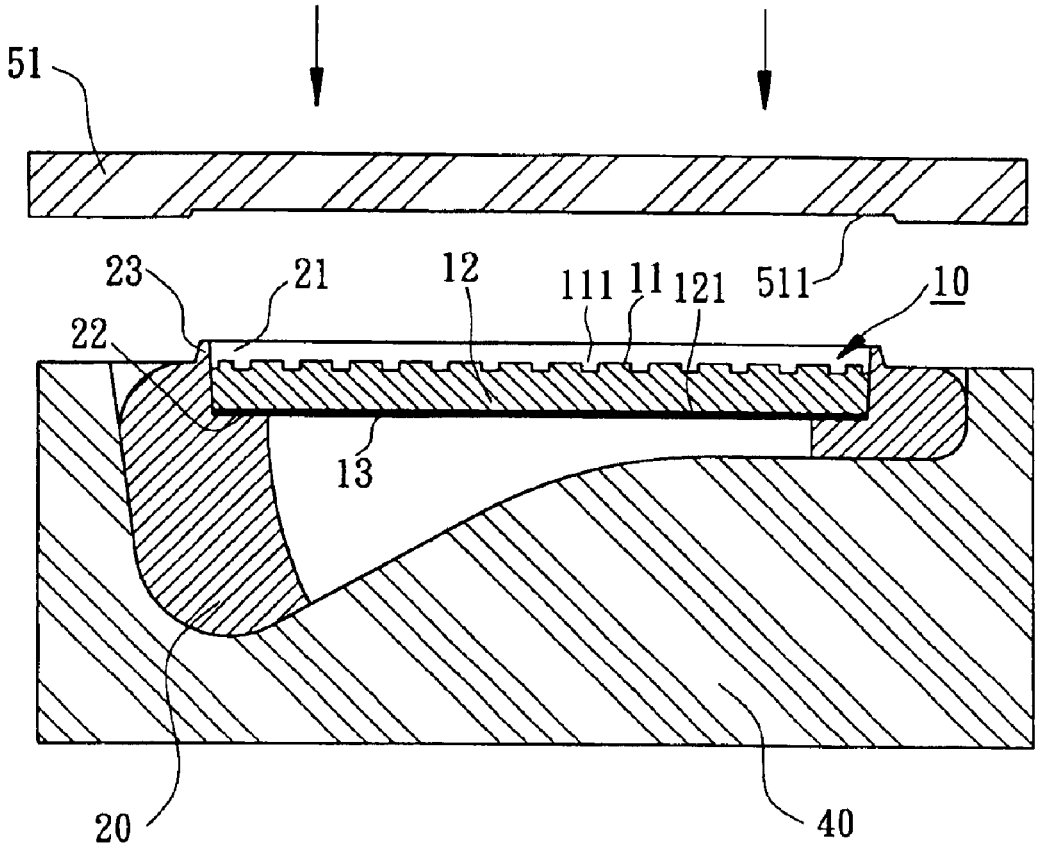
FIG. 8 is a sectional view illustrating a first pressing procedure.

As illustrated in FIG. 8, the when the striking plate 10 is inserted by tight fitting into the recession 21 of the golf club head body 20, the welding flange 23 of the golf club head 20 is pressed by the first pressing member 51, making primary deformation of the welding flange 23. The first pressing member 51 has a recessed portion 511 associated with the welding flange 23. The recessed portion 511 has an inner periphery that is also inclined. Further, the recessed portion 511 has a depth slightly smaller than that a width of the welding flange 23. Thus, the metal material of the welding flange 23 deforms inward (i.e., the primary deformation) when the recessed portion 511 presses the welding flange 23.

Figure 9:
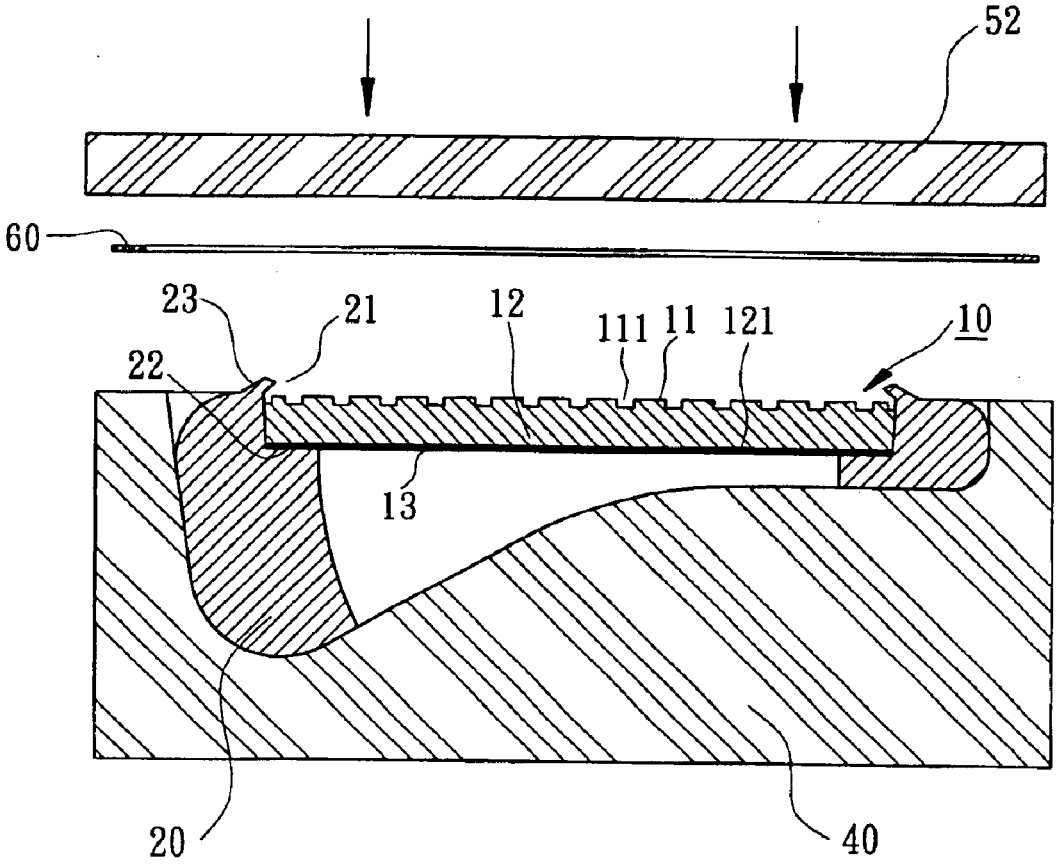
FIG. 9 is a sectional view illustrating a second pressing procedure.

As illustrated in FIG. 9, the second pressing member 52 is then used to press the welding flange 23 of the golf club head body 20 to make the final deformation of the welding flange 23, forming a thin sheet of metal that covers a boundary between the golf club head body 20 and the striking plate 10. Preferably, a gasket 60 is used to control the pressing extent of the second pressing member 52, thereby controlling the thickness of the thin sheet of metal.

Figure 10:
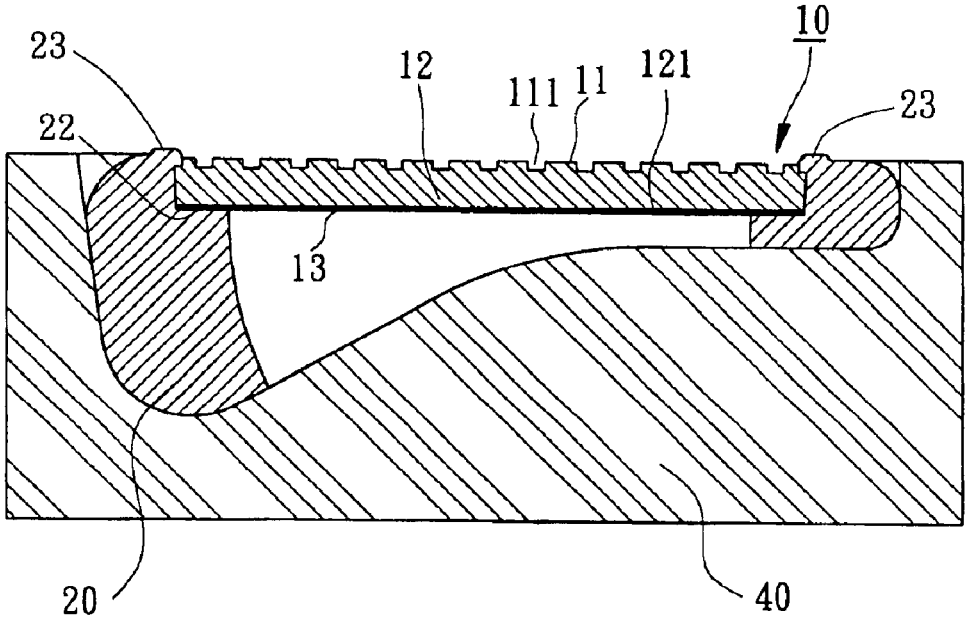
FIG. 10 is a sectional view of the golf club head after pressing.

Referring to FIG. 10, the thickness of the thin sheet of metal is preferably controlled to be 0.80±0.20 mm. This thin sheet of metal acts as a filling material for filling a gap in the boundary between the golf club head body 20 and the striking plate 10 during welding. Also, this thin sheet of metal avoids the problems of excessive depression extent of the welding bead, insufficient penetration depth of welding, etc.

After the above four steps, the striking plate 10 has tightly embedded into the recession 21 of the golf club head body 20. The deformed thin sheet of metal prevents the striking plate 10 from disengaging from the golFclub head body 20. Namely, a sufficient engaging strength exists between the striking plate 10 and the golf club head body 20. Thus, the thin sheet of metal, the striking plate 10, and the golf club head body 20 may be directly processed by milling or grinding so that the golf club head body 20 and the striking plate 10 form a flat striking surface, and appropriate surface finishing (e.g., the step S110) can be processed to rapidly provide a final product of a golf club head.

Figure 11:
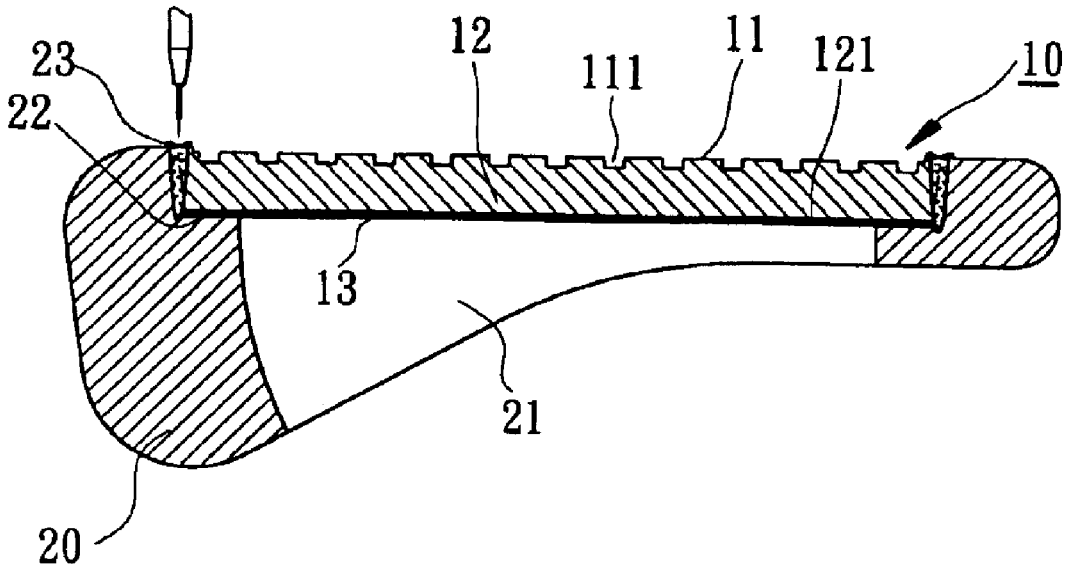
FIG. 11 is a sectional view illustrating high energy welding.

Referring to FIGS. 1 and 11, the next step of the method for manufacturing a golf club head in accordance with the present invention is welding the welding flange 23 by high energy welding to fuse the golf club head body 20 and the striking plate 10 along the boundary between the golf club head body 20 and the striking plate 10 (step S108). The high energy welding is preferably laser welding or electron-beam welding. Advantage of high energy welding includes fast welding speed, deep penetration of welding, wide welding bead (about 1.2–2.0 mm), small impact resulting from the welding heat, small deformation of the work piece, no surface deformation of the work piece resulting from high temperature oxidation, high bonding strength of welding bead, etc. Further, the gap (about 0–0.25 mm) in the boundary between the golf club head 20 and the striking plate 10 is controlled to be smaller than the diameter (about 0.3–0.5 mm) of the laser beams. Thus, the metal material on both sides of the boundary between the golf club head body 20 and the striking plate 10 can fuse completely by the laser beams.

Figure 12:
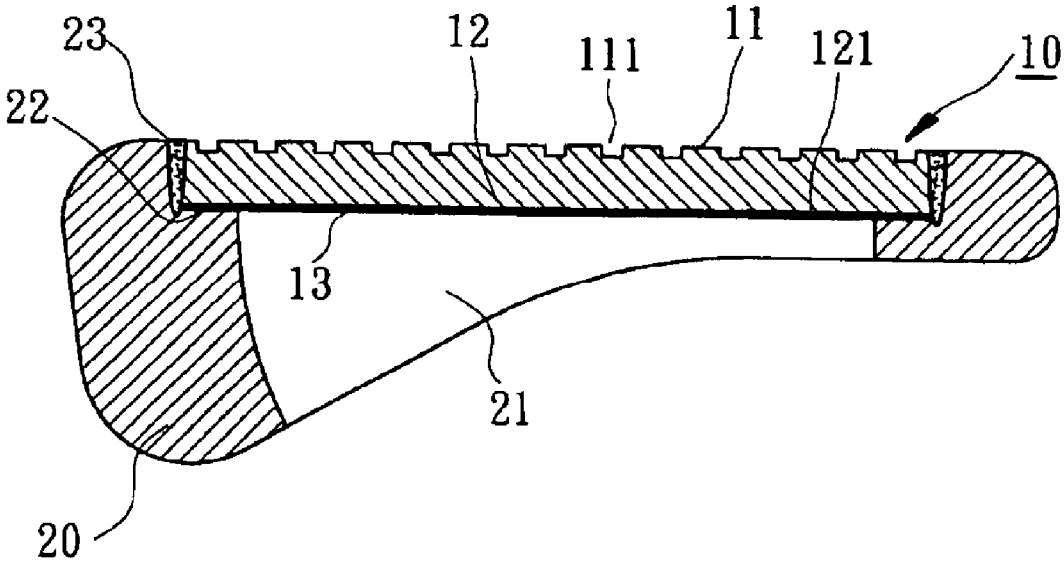
FIG. 12 is a sectional view of the golf club head after surface finishing.

Referring to FIGS. 1 and 12, the next step of the method for manufacturing a golf club head in accordance with the present invention is finishing the welded portion of the golf club head and the striking plate (step S110). The finishing may include sanding, grinding, polishing, mirror finishing, satin finishing, mechanic engraving, laser engraving, and printing of patterns or trade names, providing an aesthetically pleasing appearance and an identical specification for the club head products.

While the principles of this invention have been disclosed in connection with its specific embodiment, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A method for manufacturing a golf club head, comprising:

forming a highly polished surface on a rear face of a striking plate;

forming a reinforcing metal layer on the highly polished surface of the striking plate;

inserting the striking plate into a golf club head body having a recession and a welding flange;

deforming the welding flange of the golf club head body along an outer periphery of the striking plate;

welding the welding flange to fuse the golf club head body and the striking plate along a boundary between the golf club head body and the striking plate; and finishing welded portion of the golf club head and the striking plate.

2. The method as claimed in claim 1, wherein said deforming the welding flange is performed by using at least one pressing member, and wherein said welding the welding flange includes using high energy welding to fuse the golf club head body and the striking plate along a boundary between the golf club head body and the striking plate after the welding flange of the golf club head body is pressed and thus deformed by said at least one pressing member.

3. The method as claimed in claim 2, wherein the high energy welding is laser welding.

4. The method as claimed in claim 2, wherein the high energy welding is electron-beam welding.

5. The method as claimed in claim 1, wherein the reinforcing metal layer is formed by means of physical vapor deposition.

6. The method as claimed in claim 5, wherein the welding flange is pressed and deformed to form a thin sheet of metal that covers a boundary between the striking plate and the golf club head body and thus acts as a filling material for the high energy welding.

7. The method as claimed in claim 1, wherein the reinforcing metal layer is formed by means of plating.

8. The method as claimed in claim 1, wherein a material for the reinforcing metal layer is selected from a group consisting of titanium, zirconium, hafnium, chromium, and combinations thereof.

9. The method as claimed in claim 8, wherein the reinforcing metal layer includes nitride or carbonic nitride of the material for the reinforcing metal layer.

10. The method as claimed in claim 1, wherein the reinforcing metal layer has a thickness of 1–20 $\mu$m.

11. The method as claimed in claim 1, wherein the highly polished surface of the striking plate has a surface roughness below 6.3 $\mu$m.

12. The method as claimed in claim 1, wherein the welding flange includes an outer periphery having an inwardly inclined face.

* * * * *